United States Patent [19]

Pollet et al.

[11] 4,402,741

[45] Sep. 6, 1983

[54] PROCESS FOR THE PRECISE AND CONTINUOUS INJECTION OF A HALOGENATED DERIVATIVE IN THE GASEOUS STATE INTO A LIQUID METAL

[75] Inventors: Gilbert Pollet, La Ravoire; Pierre du Manoir, Cognin; Pierre Guerit, Chambery, all of France

[73] Assignee: Servimetal, Paris, France

[21] Appl. No.: 359,766

[22] Filed: Mar. 19, 1982

[30] Foreign Application Priority Data

Mar. 23, 1981 [FR] France ..... 81 06134

[51] Int. Cl.[3] ..... C22B 21/06

[52] U.S. Cl. ..... 75/93 E; 75/68 R

[58] Field of Search ..... 266/217–226; 75/93 E, 68 R

[56] References Cited

U.S. PATENT DOCUMENTS 2,447,672 8/1948 Smith, Jr. et al. ..... 266/225

3,958,980 5/1976 Szekely ..... 75/68 R

FOREIGN PATENT DOCUMENTS 52-23514 2/1977 Japan ..... 75/93 E

*Primary Examiner*—M. J. Andrews

*Attorney, Agent, or Firm*—McDougall, Hersh & Scott

[57] ABSTRACT

The invention relates to a process and an apparatus for the precise and continuous injection of a halogenated derivative, which is liquid at ambient temperature, into a liquid metal such as aluminum and aluminum-based alloys.

The process involves withdrawing the halogenated substance from a tank, introducing it by means of a metering pump into a vaporizer which has been brought to a temperature at least equal to the vaporization temperature of the substance under the injection pressure, and entraining it in the vapor state by an inert gas stream towards an injection means opening into the center of the liquid metal.

8 Claims, 1 Drawing Figure

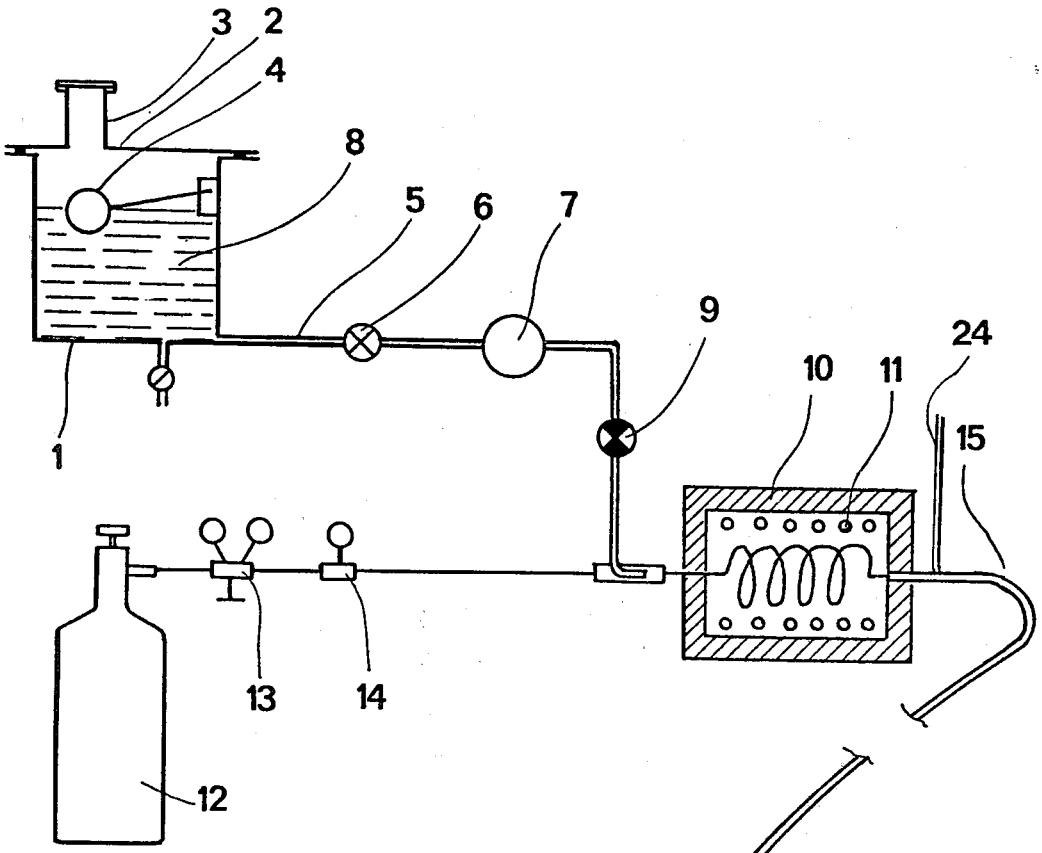
3
2
4
8
5
6
7
9
24
10
11
15
1
13
14
12
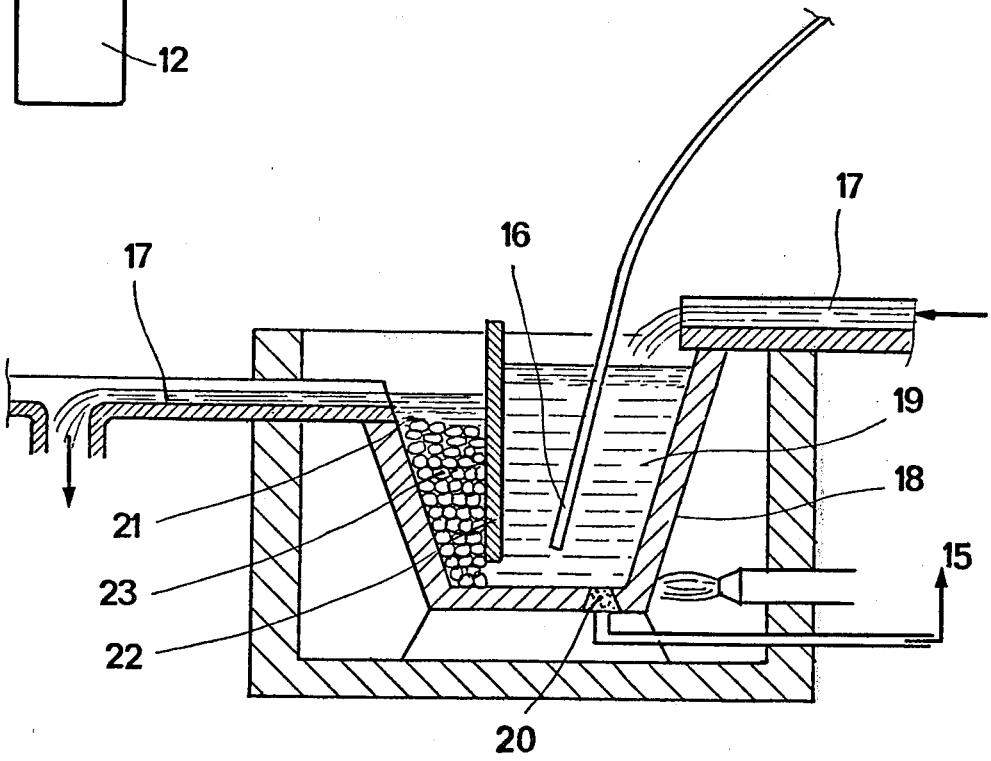
17
16
17
19
18
21
23
22
15
20

PROCESS FOR THE PRECISE AND CONTINUOUS INJECTION OF A HALOGENATED DERIVATIVE IN THE GASEOUS STATE INTO A LIQUID METAL

This invention relates to a process and an apparatus for the precise injection into a liquid metal of halogenated derivatives which are liquid or in solution.

It is mainly intended for the precise injection of predetermined quantities of liquid halogenated derivatives into aluminum and aluminum-based alloys.

It is known that aluminum and certain aluminum-based alloys have to be subjected to a purification treatment before they are put into the mold, with the particular aim of expelling occluded gases from them, eliminating certain undesirable components such as sodium, and facilitating collection of inclusions of alumina or other oxides on the surface.

This purification treatment can be carried out by various processes which are categorized in two groups:

(a) the injection of gaseous chlorine, which is pure or diluted in an inert gas (nitrogen, argon), by any known means such as a graphite rod immersed in the liquid metal, a porous stopper arranged at the bottom of a ladle, etc.;

(b) the injection of a halogenated derivative of which the decomposition at the temperature of the liquid metal liberates active chlorine.

The present invention belongs to the second group. In fact, the handling and use of chlorine in foundry works poses problems of safety, hygiene, pollution and corrosion which have led to a search for other solutions.

Halogenated derivatives which have been used include anhydrous metallic chlorides such as $TiCl_4$, $AlCl_3$, $MnCl_2$ and organic derivatives such as $CCl_4$ (carbon tetrachloride), $C_2Cl_4$ (perchloroethylene) or $C_2Cl_6$ (hexachlorothane).

These processes have been described, in particular, in "Aluminum" Volume 1, Pechiney, Editions Eyrolles, Paris 1964, pages 527–528; in Aluminum, Kent R. Van Horn, Volume III, American Society of Metals 1967, pages 31–32; and in "Aluminum Taschenbuch" 13, 1974 Edition, pages 373–375.

The use of hexachloroethane has also been described in British Pat. Nos. 603,213 and 827,619 in the name of Foseco.

This product, which is solid at ordinary temperature, sublimes at 187° C. For this reason, it is usually introduced into the aluminum in the form of tablets arranged in a chamber traversed by the liquid metal or by means of a perforated graphite bell which is lowered into the liquid metal. Its volatilization and its thermal cracking are thus extremely rapid and require scarcely more than 2 to 3 minutes. However, this speed rules out the possibility of accurate metering and, in particular, of continuous action on a liquid aluminum stream. Moreover, since the doses utilized are much larger than the quantity actually needed, the surplus has to be collected effectively.

This invention is based on the use of a halogenated substance which is liquid at ambient temperature and has a Cl/C atomic ratio of at least 2 and preferably between 2 and 4.

The process forming the subject of the invention involves taking the halogenated substance or the halogenated solution which is liquid at ambient temperature, introducing it by means of a metering micropump into a vaporizer which has been brought to a temperature such that the substance is brought to a temperature higher than its vaporization temperature, and injecting the vapor into the liquid metal to be treated under the influence of an inert gas stream.

Hereinafter, a defined chemical compound or a mixture of defined chemical compounds composed of carbon and of at least one halogen selected from chlorine and fluorine will be designated by the term "halogenated substance".

The apparatus for carrying out the process comprises a tank of liquid halogenated substance, a metering micropump, a reactor equipped with heating means, a source of inert gas under pressure provided with means for regulating the pressure and the flow rate, and means for injection into the liquid metal to be treated.

FIG. 1 shows the apparatus diagrammatically. It is composed of a tank 1 provided with a sealed cover 2, a closeable nozzle 3 to permit filling, and a level gauge 4. An extraction tube 5 equipped with a check valve 6 is connected to a piston-type metering micropump 7 capable of precisely withdrawing and injecting the halogenated substance 8 at a rate of between 0.1 and 10 milliliters per minute, for example, these values not limiting the invention.

The liquid halogenated substance 8 reaches a nonreturn valve 9 and enters the vaporizer 10 equipped with a regulated and thermostatically controlled heating means 11 of any known type, for example of the electric resistance type.

An inert gas such as nitrogen, argon and helium, which is withdrawn from the compressed storage means 12 via a pressure reducer 13 and a flow meter 14, also enters the vaporizer where it mixes with the vapors of the halogenated substance and entrains them via the injection pipe 15 towards the injection means 16 which can be, for example, a graphite rod immersed in the liquid metal 17 traversing the treatment ladle 18.

A variation of the apparatus for larger flows of treatment gas involves adding to the system described above a supplementary flow of gas such as nitrogen, argon or helium which is introduced downstream of the vaporizer 10 by a branch pipe 24 on the pipe 15. This permits the desired quantity of halogen with a predetermined level of dilution to be obtained within the operating range of the micropump without causing the entire gas flow to pass into the vaporizer.

The halogenated product 8 may be perchloroethylene $Cl_2C{=}CCl_2$, which is liquid at ambient temperature (melting point: −22° C.; boiling point: +121° C.), with a Cl/C atomic ratio of 2 and a content by weight of Cl of 74.7% or, preferably, a solution of hexachloroethane $C_2Cl_6$, which is solid at ambient temperature and has a Cl/C atomic ratio of 3 and a content by weight of chlorine of 89.9%, in perchloroethylene $C_2Cl_4$. This solution has the advantage of a content by weight of chlorine which is higher than that of pure $C_2Cl_4$, while maintaining the advantage of the liquid state which enables it to be injected accurately by a metering pump. If the mixture is to be kept in its liquid state at temperatures close to ambient temperature, it is possible to introduce up to approximately 500 grams per liter of $C_2Cl_6$.

To avoid problems of crystallization during storage, a solution containing from 0.1 to 30% and preferably from 15 to 20% by weight of $C_2Cl_6$ was selected.

The use of carbon tetrachloride $CCl_4$, although theoretically attractive owing to its Cl/C ratio of 4 and its chlorine content of 92.2%, is avoided in practice owing to its toxicity.

The halogenated substance can also be formed partially or totally of chlorofluorinated derivatives and, in particular, $CCl_3F$, $CCl_3—CF_3$, $CCl_2F—CClF_2$, $CCl_3—CClF_2$, $CCl_2F—CCl_2F$, $CCl_3—CCl_2F$, of which the boiling points range between 24° and 138° C.

It is also possible to add to the halogenated substance certain physically and chemically compatible additives such as titanium tetrachloride ($TiCl_4$), the effect of which on the particle size of aluminum is well known, or, possibly, boron trichloride ($BCl_3$), by means of which impurities having a harmful influence on the electrical conductivity of aluminum such as titanium, zirconium, chromium and vanadium can be eliminated in the form of insoluble borides.

The injection pump is a piston-type displacement pump designed to deliver small predetermined volumes of liquid accurately and with a reliability of ±1% by volume. A diaphragm pump can also be used.

The vaporizer preferably comprises a spiral tube or a bank of parallel tubes so that the halogenated substance and the vector gas can leave it at a temperature which may attain 200° C. and even higher if necessary, but which is sufficient to avoid condensation and which should be adapted to the selected halogenated derivative and to the pressure at which injection is effected.

Heating is effected by an electrical resistance which is regulated by a temperature sensor arranged on the path of the gases leaving the vaporizer.

Injection into the liquid metal can be effected by various known means, for example by a graphite rod 16 arranged in the upstream compartment 19 of the treatment ladle 18 which the metal to be purified enters, or by a porous stopper 20 placed at the bottom of the ladle by a well known method (French Pat. No. 1,031,504).

The downstream compartment 21 is separated from the upstream compartment by a partition 22 and it can comprise any known filtration means such as balls or granules of alumina 23.

Injection can also be carried out in rotational devices such as the spinning nozzle inert flotation system (SNIF), manufactured by Union Carbide (U.S. Pat. No. 3,870,511), as a substitute for the injection of chlorine, or in similar screw or turbine type devices in which the halogenated vapors and the vector gas enter via the axis.

It may be necessary to insulate the injection pipe 15 if it is relatively long and if a proportion of the vaporized product is likely to recondense before it enters the injection device.

In the embodiment shown in FIG. 1, the metal is treated continuously during its passage by injection of the halogenated substance. However, it is not contrary to the invention to treat successive charges of metal in a crucible or in a sloping hearth furnace in the same way.

EXAMPLE

An injection device was constructed in accordance with the diagram in FIG. 1, comprising a 10 liter tank of a mixture containing 80% by weight of perchloroethylene and 20% by weight of hexachloroethane.

The metering micropump has a flow rate which can be adjusted between 1 and 10 milliliters per minute.

The vaporizer is preheated to 280°±5° C. The vector gas is nitrogen which is injected at a pressure of 2.5 bar and at a flow rate of 2 $m^3$ per hour.

Some non-alloyed aluminum of A5 quality (Al≧99.5%) intended for the semi-continuous casting of strips was thus treated in a continuous manner.

The quantity of perchloroethylene-hexachloroethane mixture was adjusted to 250 milliliters per hour, corresponding to 100 grams of chlorine at an aluminum flow rate in the treatment ladle of 2 tons per hour.

Conventional tests demonstrated that the hydrogen content of the cast aluminum was from 0.12 $cm^3$ per 100 g, equivalent to that obtained by conventional treatment using an argon-chlorine mixture.

During the treatment, fumes above the ladle occurred in a very small quantity or not at all, and the presence of phosgene was not detected, even in the immediate vicinity of the ladle.

Overall, the implementation of the invention has the following advantages:

(i) continuous operation of injection, even over a prolonged period of time, because the tank can be refilled with halogenated substance without interrupting the injection process, (ii) very accurate metering which can be adjusted at will, eliminating any risk of over-addition and leading to a chlorine yield of approximately 100%, (iii) no liberation of harmful products and virtually no liberation of fumes above the tank, (iv) compatibility with the means and apparatus for the treatment of aluminum, such as ladles, injection rods, porous stoppers; with or without the use of filtration means or covers for halogenated flux, (v) no problems in the storage of the halogenated substance which is stable, non-inflammable, non-corrosive and of which the vapor tension, which is relatively low at ambient temperature, ensures a very low toxicity level.

This process eliminates all the problems associated with the use of gaseous chlorine (storage, dangers of leakage, corrosion, maintenance of installations, treatment of the gaseous effluents etc.)

We claim:

1. A process for the continuous injection of a precise volume of a halogenated substance into a stream of liquid metal, said substance being liquid at ambient temperature and selected from the group consisting of perchloroethylene, hexachloroethane, carbon tetrachloride $CCl_3F$, $CCl_3—CF_3$, $CCl_2F—CClF_2$, $CCl_3—CClF_2$, $CCl_2F—CCl_2F$, and $CCl_3—CCl_2F$, comprising withdrawing the halogenated substance from a reservoir, introducing a predetermined volume of the substance under pressure through a metering pump into a vaporizer maintained at a temperature at least equal to the vaporization temperature of the substance, and entraining the substance in the vapor state within an inert gas stream for passage through an injection means in communication with the liquid metal.

2. An injection process according to claim 1 wherein additional inert gas is introduced downstream of the vaporizer.

3. An injection process according to claim 1 or 2 wherein the injection means is arranged in a ladle traversed by the liquid metal stream.

4. An injection process according to claim 1 or 2 wherein the injection means is arranged in a crucible.

5. An injection process according to claim 1 or 2 wherein the halogenated substance comprises a solution of hexachloroethane in perchloroethylene at a concentration from 0.1 to 30% by weight of hexachloroethane.

6. An injection process according to claim 5 wherein the halogenated substance also contains at least one anhydrous metal halide selected from the group consisting of $TiCl_4$ and $BCl_3$.

7. An injection process according to claim 1 or 2 wherein the injection means is arranged in a sloping hearth furnace.

8. An injection process according to claim 1 or 2 wherein the halogenated substance comprises a solution of hexachloroethane in perchloroethylene at a concentration from 15 to 20% by weight of hexachloroethane.

* * * * *